US007136038B2

(12) United States Patent
Ha et al.

(10) Patent No.: US 7,136,038 B2
(45) Date of Patent: Nov. 14, 2006

(54) GAMMA VOLTAGE GENERATING APPARATUS USING VARIABLE RESISTOR FOR GENERATING A PLURALITY OF GAMMA VOLTAGES IN CORRESPONDENCE WITH VARIOUS MODES

(75) Inventors: Won Kyu Ha, Kyoungsangbuk-do (KR); Eun Myung Park, Daegu (KR); Hak Su Kim, Deagu (KR)

(73) Assignee: LG Electronics Inc., Seoul (KR)

( * ) Notice: Subject to any disclaimer, the term of this patent is extended or adjusted under 35 U.S.C. 154(b) by 133 days.

(21) Appl. No.: 10/900,374

(22) Filed: Jul. 28, 2004

(65) Prior Publication Data

US 2005/0062736 A1 Mar. 24, 2005

(30) Foreign Application Priority Data

Jul. 30, 2003 (KR) ..... 10-2003-0052681
Jul. 30, 2003 (KR) ..... 10-2003-0052684

(51) Int. Cl.
*G09G 3/36* (2006.01)

(52) U.S. Cl. ..... 345/89; 345/240; 345/690

(58) Field of Classification Search ..... None
See application file for complete search history.

(56) References Cited

U.S. PATENT DOCUMENTS 6,657,619 B1 * 12/2003 Shiki ..... 345/204
6,778,161 B1 * 8/2004 Chen et al. ..... 345/89
7,030,840 B1 * 4/2006 Mametsuka ..... 345/76
2004/0113923 A1 * 6/2004 Ha et al. ..... 345/690

* cited by examiner

*Primary Examiner*—Tuyet Thi Vo
(74) *Attorney, Agent, or Firm*—Birch, Stewart, Kolasch & Birch, LLP

(57) ABSTRACT

A gamma voltage generating apparatus for reducing the number of parts to simplify a structure thereof is disclosed. The apparatus is operated in various modes such that a brightness value can be changed in correspondence with an external environment. A red gamma voltage generator has at least one variable resistor to generate a plurality of red gamma voltages and control the plurality of red gamma voltages such that said brightness value can be changed in correspondence with each of said various modes. A green gamma voltage generator has at least one variable resistor to generate a plurality of green gamma voltages and control the plurality of green gamma voltages such that said brightness value can be changed in correspondence with each of said various modes. A blue gamma voltage generator has at least one variable resistor to generate a plurality of blue gamma voltages and control the plurality of blue gamma voltages such that said brightness value can be changed in correspondence with each of said various modes.

21 Claims, 7 Drawing Sheets

GAMMA VOLTAGE GENERATING APPARATUS USING VARIABLE RESISTOR FOR GENERATING A PLURALITY OF GAMMA VOLTAGES IN CORRESPONDENCE WITH VARIOUS MODES

This application claims the benefit of Korean Patent Application Nos. P2003-52681 and P2003-52684 filed in Korea on Jul. 30, 2003, which are hereby incorporated by reference.

BACKGROUND OF THE INVENTION

1. Field of the Invention

This invention relates to a gamma voltage generating apparatus for a display device, and more particularly to a gamma voltage generating apparatus that is adaptive for reducing the number of parts to simplify a structure thereof.

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display, etc.

The EL display in such display devices is a self-luminous device capable of light-emitting a phosphorous material by a re-combination of electrons with holes. The EL display device is generally classified into an inorganic EL device using an inorganic compound as the phosphorous material and an organic EL using an organic compound as the phosphorous material. The EL display has the same advantage as the CRT in that it has a faster response speed than a passive-type light-emitting device requiring a separate light source. Further, the EL display device has many advantages of a low voltage driving, a self-luminescence, a thin-thickness, a wide viewing angle, a fast response speed and a high contrast, etc. such that it can be highlighted into a post-generation display device.

FIG. 1 is a section view showing a general organic EL structure for explaining a light-emitting principle of the EL display device.

Referring to FIG. 1, the organic EL device is comprised of an electron injection layer 4, an electron carrier layer 6, a light-emitting layer 8, a hole carrier layer 10 and a hole injection layer 12 that are sequentially disposed between a cathode 2 and an anode 14.

If a voltage is applied between a transparent electrode, that is, the anode 14 and a metal electrode, that is, the cathode 2, then electrons produced from the cathode 2 are moved, via the electron injection layer 4 and the electron carrier layer 6, into the light-emitting layer 8 while holes produced from the anode 14 are moved, via the hole injection layer 12 and the hole carrier layer 10, into the light-emitting layer 10. Thus, the electrons and the holes fed from the electron carrier layer 6 and the hole carrier layer 10, respectively, are collided at the light-emitting layer to be recombined to thereby generate a light, and this light is emitted, via the transparent electrode (i.e., the anode 14), into the exterior to thereby display a picture. Since a light-emitting brightness of the organic EL device is in proportion to a supply current rather than being in proportion to a voltage loaded on each end of the device, the anode 14 is generally connected to a positive current source.

FIG. 2 schematically shows a general EL display device.

Referring to FIG. 2, the EL display device includes an EL panel 20 having EL cells 28 arranged at intersections between scan electrode lines SL and data electrode lines DL, a scan driver 22 for driving the scan electrode lines SL, a data driver 24 for driving the data electrode lines DL, and a gamma voltage generator 26 for supplying a plurality of gamma voltages to the data driver 24.

Each of EL cells 28 is selected when a scanning pulse is applied to the scan electrode line SL as a cathode to thereby generate a light corresponding to a pixel signal, that is, a current signal applied to the data electrode line DL as an anode. Each EL cell 28 can be equivalently expressed as a diode connected between the data electrode line DL and the scan electrode line SL. Each EL cell 28 is light-emitted when a negative scanning pulse to the scan electrode line SL and, at the same time, a positive current according to a data signal is applied to the data electrode line DL to thereby load a forward current. Otherwise, the EL cells 28 included in the unselected scan line are supplied with a backward current to thereby be not light-emitted. In other words, forward electric charges are charged in the emitting EL cells 28 while backward electric charges are charged in the non-emitting EL cells 28.

The scan driver 22 applies a negative scanning pulse to a plurality of scan electrode lines SL on a line-sequence basis.

The data driver 24 converts a digital data signal inputted from the exterior thereof into an analog data signal using a gamma voltage from the gamma voltage generator 26. Further, the data driver 24 applies the analog data signal to the data lines DL whenever the scanning pulse is supplied.

As mentioned above, the conventional EL display device applies a current proportional to an input data to each EL cell 28 to light-emit each EL cell 28, thereby displaying a picture. The EL cells 28 consist of a red (R) cell having a red phosphorous material, a green (G) cell having a green phosphorous material and a blue (B) cell having a blue phosphorous material. The three R, G and B cells are combined to thereby implement a color for one pixel. Herein, the R, G and B phosphorous materials have different light-emission efficiency. In other words, when data signals having the same level are applied to the R, G and B cells, brightness levels of the R, G and B cells become different from each other. Thus, gamma voltages are set differently for each R, G and B cell with respect to the same brightness for the sake of white balance of the R, G and B cells. Accordingly, the gamma voltage generator 26 for supplying gamma voltages to the data driver 24 generates a gamma voltage for each R, G and B cell.

FIG. 3 is a detailed circuit diagram of the gamma voltage generator shown in FIG. 2.

Referring to FIG. 3, the conventional gamma voltage generator includes an R gamma voltage generator 32, a G gamma voltage generator 34 and a B gamma voltage generator 36 in order to supply gamma voltage for each R, G and B cell.

The R gamma voltage generator 32 has voltage-dividing resistors r_R1, r_R2 and r_R3 connected, in series, between a supply voltage source VDD and a ground voltage source GND. Herein, voltages from common nodes n1 and n2 of the voltage-dividing resistors r_R1, r_R2 and r_R3 are inputted to the data driver 24 as gamma voltages. At this time, a high gray level of R gamma voltage VH_R is generated on a basis of the following equation (1) while a low gray level of R gamma voltage VL_R is generated on a basis of the following equation (2).

$$\text{VH_R(a low gray level of } R \text{ gamma voltage)} = \frac{\text{r_R2} + \text{r_R3}}{\text{r_R1} + \text{r_R2} + \text{r_R3}} * VDD \quad (1)$$

$$\text{VL_R(a high gray level of } R \text{ gamma voltage)} = \frac{\text{r_R3}}{\text{r_R1} + \text{r_R2} + \text{r_R3}} * VDD \quad (2)$$

The G gamma voltage generator 34 has voltage-dividing resistors r_G1, r_G2 and r_G3 connected, in series, between the supply voltage source VDD and the ground voltage source GND. Herein, voltages from common nodes n3 and n4 of the voltage-dividing resistors r_G1, r_G2 and r_G3 are inputted to the data driver 24 as gamma voltages. At this time, a high gray level of G gamma voltage VH_G is generated on a basis of the following equation (3) while a low gray level of G gamma voltage VL_G is generated on a basis of the following equation (4).

$$\text{VH_G(a low gray level of } G \text{ gamma voltage)} = \frac{\text{r_G2} + \text{r_G3}}{\text{r_G1} + \text{r_G2} + \text{r_G3}} * VDD \quad (3)$$

$$\text{VL_G(a high gray level of } G \text{ gamma voltage)} = \frac{\text{r_G3}}{\text{r_G1} + \text{r_G2} + \text{r_G3}} * VDD \quad (4)$$

The B gamma voltage generator 36 has voltage-dividing resistors r_B1, r_B2 and r_B3 connected, in series, between the supply voltage source VDD and the ground voltage source GND. Herein, voltages from common nodes n5 and n6 of the voltage-dividing resistors r_B1, r_B2 and r_B3 are inputted to the data driver 24 as gamma voltages. At this time, a high gray level of B gamma voltage VH_B is generated on a basis of the following equation (5) while a low gray level of B gamma voltage VL_B is generated on a basis of the following equation (6).

$$\text{VH_B(a low gray level of } B \text{ gamma voltage)} = \frac{\text{r_B2} + \text{r_B3}}{\text{r_B1} + \text{r_B2} + \text{r_B3}} * VDD \quad (5)$$

$$\text{VL_B(a high gray level of } B \text{ gamma voltage)} = \frac{\text{r_B3}}{\text{r_B1} + \text{r_B2} + \text{r_B3}} * VDD \quad (6)$$

Meanwhile, the conventional EL display device further includes a gamma voltage generator for each mode as shown in FIG. 4 and FIG. 5 such that brightness is changed in correspondence with various environments. Herein, resistors included the gamma voltage generator for each mode have resistance values established such that brightness corresponding to an environment (light), such as night, noon, the exterior, the interior and the like, can be generated.

For instance, the R gamma voltage generator 32 of the second mode gamma voltage generator shown in FIG. 4 includes voltage-dividing resistors r_R4, r_R5 and r_R6 connected, in series, between the supply voltage source VDD and the ground voltage source GND. Herein, resistance values of the voltage-dividing resistors r_R4, r_R5 and r_R6 are set differently from those of the voltage-dividing resistors r_R1, r_R2 and r_R3 included in the R gamma voltage generator 32 shown in FIG. 3. Thus, gamma voltage values generated at the second mode gamma voltage generator are set differently from gamma voltage values generated at the R gamma voltage generator 32 shown in FIG. 3. These gamma voltage values are supplied to the EL display device in correspondence with an environment, thereby allowing the EL display device to generate an optimum brightness corresponding to an external environment. Herein, resistance values of voltage-dividing resistors r_R7, r_R8 and r_R9 are set differently from those of the voltage-dividing resistors r_R1, r_R2, r_R3, r_R4, r_R5 and r_R6 included in the R gamma voltage generators 32 shown in FIG. 3 and FIG. 4.

However, the gamma voltage generator corresponding to each mode in this manner must generates a high gray level of R gamma voltage VH_R and a low gray level of R gamma voltage VL_R applied to the R cell, a high gray level of G gamma voltage VH_G and a low gray level of R gamma voltage VL_G applied to the G cell, and a high gray level of B gamma voltage VH_B and a low gray level of B gamma voltage VL_B applied to the B cell. In other words, the gamma voltage generator must generate all of a high gray level of gamma voltage VH_R, VH_G and VH_B and a low gray level of gamma voltages VL_R, VL_G and VL_B. To this end, since the R, G and B gamma voltage generators 32, 34 and 36 of the gamma voltage generator generates a high gray level of gamma voltage VH_R, VH_G and VH_B and a low gray level of gamma voltages VL_R, VL_G and VL_B among three resistors connected in series, nine resistors are provided for each mode. Thus, when three modes are used, the conventional gamma voltage generator must be provided with total 27 resistors. Accordingly, the conventional EL display device has a problem in that many different parts are provided at the module to have a complicate structure.

SUMMARY OF THE INVENTION

Accordingly, it is an object of the present invention to provide a gamma voltage generating apparatus that is adaptive for reducing the number of parts to simplify a structure thereof.

In order to achieve these and other objects of the invention, a gamma voltage generating apparatus according to an embodiment of the present invention operated in various modes such that a brightness value can be changed in correspondence with an external environment includes a red gamma voltage generator, having at least one variable resistor, for generating a plurality of red gamma voltages and controlling the plurality of red gamma voltages such that said brightness value can be changed in correspondence with each of said various modes; a green gamma voltage generator, having at least one variable resistor, for generating a plurality of green gamma voltages and controlling the plurality of green gamma voltages such that said brightness value can be changed in correspondence with each of said various modes; and a blue gamma voltage generator, having at least one variable resistor, for generating a plurality of blue gamma voltages and controlling the plurality of blue gamma voltages such that said brightness value can be changed in correspondence with each of said various modes.

In the gamma voltage generating apparatus, each of the red, green and blue gamma voltage generators includes a supply voltage source; a first resistor and a variable resistor connected to the supply voltage source; and i parallel resistors (wherein i is an integer) connected, in parallel, between the variable resistor and a ground voltage source.

Herein, a gamma voltage corresponding to a first gray level is generated from a first common node between the first resistor and the variable resistor, and a gamma voltage corresponding to a second gray level is generated from a common node of the variable resistor connected, in parallel, between the first common node and the ground voltage source and said i parallel resistors.

A plurality of switches is provided between said i parallel resistors and the ground voltage source.

Herein, the switches are turned on and off in correspondence with each of said modes, and values of said gamma voltages corresponding to the first and second gray levels are changed when the switches are turned on and off.

Resistance values of the first resistor, the variable resistor and said i parallel resistors are set differently at each of the red, green and blue gamma voltage generators.

Herein, resistance values of said resistors included in each of the red, green and blue gamma voltage generators are set in compliance with a white balance of red, green and blue cells.

A gamma voltage generating apparatus according to another embodiment of the present invention operated in various modes such that a brightness value can be changed in correspondence with an external environment includes a red gamma voltage generator, having at least one variable resistor device for generating a plurality of red gamma voltages and controlling the plurality of red gamma voltages such that said brightness value can be changed in correspondence with each of said various modes, for generating the plurality of red gamma voltages corresponding to each of said modes by at least two resistor devices connected, in series, between the variable resistor device and a ground voltage source; a green gamma voltage generator, having at least one variable resistor device for generating a plurality of green gamma voltages and controlling the plurality of green gamma voltages such that said brightness value can be changed in correspondence with each of said various modes, for generating the plurality of green gamma voltages corresponding to each of said modes by at least two resistor devices connected, in series, between the variable resistor device and the ground voltage source; and a blue gamma voltage generator, having at least one variable resistor device for generating a plurality of blue gamma voltages and controlling the plurality of blue gamma voltages such that said brightness value can be changed in correspondence with each of said various modes, for generating the plurality of blue gamma voltages corresponding to each of said modes by at least two resistor devices connected, in series, between the variable resistor device and the ground voltage source;

In the gamma voltage generating apparatus, each of the red, green and blue gamma voltage generators includes a supply voltage source; a first resistor device and a variable resistor device connected to the supply voltage source; and i serial resistor devices (wherein i is an integer) connected, in series, between the variable resistor device and the ground voltage source.

Herein, a gamma voltage corresponding to a first gray level is generated from a first common node between the first resistor device and the variable resistor device, and a gamma voltage corresponding to a second gray level is generated from each node between said i serial resistor devices connected, in series, the variable resistor device and the ground voltage source.

Said second gray level is generated from each node between said i serial resistor devices in correspondence with each of said modes.

Resistance values of the first resistor device, the variable resistor device and said i serial resistor devices are set differently at each of the red, green and blue gamma voltage generators.

Herein, resistance values of said resistor devices included in each of the red, green and blue gamma voltage generators are set in compliance with a white balance of red, green and blue cells.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 6 and 7.

Figure 6:
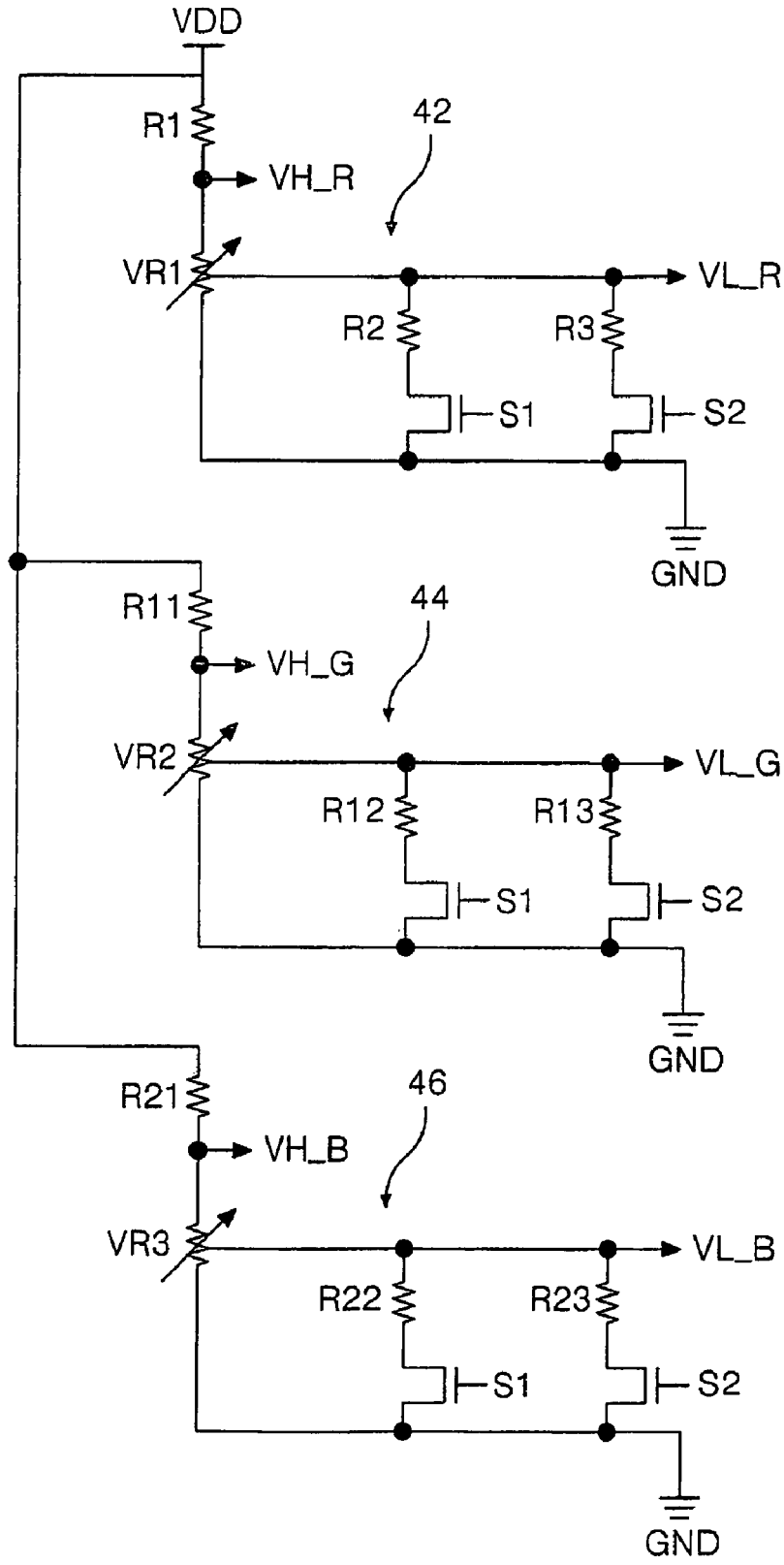
FIG. 6 is a circuit diagram of a gamma voltage generating apparatus according to a first embodiment of the present invention.

FIG. 6 is a circuit diagram of a gamma voltage generating apparatus according to a first embodiment of the present invention.

Referring to FIG. 6, the gamma voltage generating apparatus includes an R gamma voltage generator 42, a G gamma voltage generator 44 and a B gamma voltage generator 46 in order to supply a gamma voltage for each R, G and B cell. Herein, each of the R, G and B gamma voltage generators 42, 44 and 46 generates a gamma voltage in various modes in such a manner to correspond to an external environment.

The R gamma voltage generator 42 generates a low gray level of R gamma voltage VL_R and a high gray level of R gamma voltage VH_R and applies them to the R cell in order to express a low gray level (i.e., black) and a high gray level (i.e., white). To this end, the R gamma voltage generator 42 includes a first voltage-dividing resistor R1 and a first variable resistor VR1 connected, in series, to a supply voltage source VDD, second and third voltage-dividing resistors R2 and R3 connected, in parallel, between the first variable resistor VR1 and a ground voltage source GND, a first switch S1 connected between the second voltage-dividing resistor R2 and the ground voltage source GND, and a second switch S2 connected between the third voltage-dividing resistor R3 and the ground voltage source GND. Herein, the gamma voltage generating apparatus can use the first variable resistor VR1 to effectively cope with various conditions of the panel. In other words, the gamma voltage generating apparatus can flexibly cope with a resolution variation or a material variation of the panel by utilizing the first variable resistor VR1.

The G gamma voltage generator 44 generates a low gray level of G gamma voltage VL_G and a high gray level of G gamma voltage VH_G and applies them to the G cell in order to express a low gray level (i.e., black) and a high gray level (i.e., white). To this end, the G gamma voltage generator 44 includes a 11th voltage-dividing resistor R11 and a second variable resistor VR2 connected, in series, to the supply voltage source VDD, 12th and 13th voltage-dividing resistors R12 and R13 connected, in parallel, between the second variable resistor VR2 and the ground voltage source GND, a first switch S1 connected between the 12th voltage voltage-dividing resistor R12 and the ground voltage source GND, and a second switch S2 connected between the 13th voltage-dividing resistor R13 and the ground voltage source GND. Herein, the gamma voltage generating apparatus can use the second variable resistor VR2 to effectively cope with various conditions of the panel. In other words, the gamma voltage generating apparatus can flexibly cope with a resolution variation or a material variation of the panel by utilizing the second variable resistor VR2.

The B gamma voltage generator 46 generates a low gray level of B gamma voltage VL_B and a high gray level of B gamma voltage VH_B and applies them to the B cell in order to express a low gray level (i.e., black) and a high gray level (i.e., white). To this end, the B gamma voltage generator 46 includes a 21st voltage-dividing resistor R21 and a third variable resistor VR3 connected, in series, to the supply voltage source VDD, 22nd and 23rd voltage-dividing resistors R22 and R23 connected, in parallel, between the third variable resistor VR3 and the ground voltage source GND, a first switch S1 connected between the 22nd voltage voltage-dividing resistor R22 and the ground voltage source GND, and a second switch S2 connected between the 23rd voltage-dividing resistor R23 and the ground voltage source GND. Herein, the gamma voltage generating apparatus can use the third variable resistor VR3 to effectively cope with various conditions of the panel. In other words, the gamma voltage generating apparatus can flexibly cope with a resolution variation or a material variation of the panel by utilizing the third variable resistor VR3.

A first mode is automatically selected when the first and second switches S1 and S2 have been turned off. Thus, a low gray level of R gamma voltage VL_R and a high gray level of R gamma voltage VH_R when the first mode is selected are generated by a voltage division of the first voltage-dividing resistor R1 and the first variable resistor VR1 connected, in series, between the supply voltage source VDD and the ground voltage source GND. When the first mode is selected, a low gray level of G gamma voltage VL_G and a high gray level of G gamma voltage VH_G are generated by a voltage division of the 11th voltage-dividing resistor R11 and the second variable resistor VR2 connected, in series, between the supply voltage source VDD and the ground voltage source GND. When the first mode is selected, a low gray level of B gamma voltage VL_B and a high gray level of B gamma voltage VH_B are generated by a voltage division of the 21st voltage-dividing resistor R21 and the third variable resistor VR3 connected, in series, between the supply voltage source VDD and the ground voltage source GND. Herein, since a high gray level of R, G and B gamma voltages VH_R, VH_G and VH_B generated by the R, G and B gamma voltage generators 42, 44 and 46 generate a brightness difference in correspondence with each light-emission efficiency of the R, G and B cells when a high gray level (i.e., white) is expressed (wherein the white is expressed by a combination of gray levels of the R, G and B cells), a high gray level of R gamma voltage VH_R, a high gray level of G gamma voltage VH_G and a high gray level of B gamma voltage VH_B applied to the R cell, the G cell and B cell, respectively are set in compliance with a white balance. At this time, when a high gray level, that is, a white is expressed, a high gray level of R, G and B gamma voltages VH_R, VH_G and VH_B can be flexibly controlled to effectively cope with various conditions of the panel with the aid of the first to third variable resistors VR1 to VR3.

When a second mode is selected, the first switch S1 is turned on. If the first switch S1 is turned on, then a parallel resistance value of the first variable resistor VR1 and the second voltage-dividing resistor R2 emerges between the first voltage-dividing resistor R1 and the ground voltage source GND in the R gamma voltage generator 42. That is to say, the resistance value is differentiated from the first mode. Thus, a low gray level of R gamma voltage VL_R and a high gray level of R gamma voltage VH_R when the second mode is selected are generated by a voltage division caused by a parallel resistance value of the first voltage-dividing R1 connected, in series, to the supply voltage source VDD and the first variable resistor VR1 and the second voltage-dividing resistor R2 connected, in parallel, between the first voltage-dividing resistor R1 and the ground voltage source GND. Further, if the first switch S1 is turned on, then a parallel resistance value of the second variable resistor VR2 and the 12th voltage-dividing resistor R12 emerges between the 11th voltage-dividing resistor R11 and the ground voltage source GND in the G gamma voltage generator 44. That is to say, the resistance value is differentiated from the first mode. Thus, a low gray level of G gamma voltage VL_G and a high gray level of G gamma voltage VH_G when the second mode is selected are generated by a voltage division caused by a parallel resistance value of the 11th voltage-dividing R11 connected, in series, to the supply voltage source VDD and the second variable resistor VR2 and the 12th voltage-dividing resistor R12 connected, in parallel, between the 11th voltage-dividing resistor R11 and the ground voltage source GND. Furthermore, if the first switch S1 is turned on, then a parallel resistance value of the third variable resistor VR3 and the 22nd voltage-dividing resistor R22 emerges between the 11th voltage-dividing resistor R11 and the ground voltage source GND in the B gamma voltage generator 46. That is to say, the resistance value is differentiated from the first mode. Thus, a low gray level of B gamma voltage VL_B and a high gray level of B gamma voltage VH_B when the second mode is selected are generated by a voltage division caused by a parallel resistance value of the 21st voltage-dividing R21 connected, in series, to the supply voltage source VDD and the third variable resistor VR3 and the 22nd voltage-dividing resistor R22 connected, in parallel, between the 21st voltage-dividing resistor R21 and the ground voltage source GND. Herein, since a high gray level of R, G and B gamma voltages VH_R, VH_G and VH_B generated by the R, G and B gamma voltage generators 42, 44 and 46 generate a brightness difference in correspondence with each light-emission efficiency of the R, G and B cells when a high gray level (i.e., white) is expressed, a high gray level of R gamma voltage VH_R, a high gray level of G gamma voltage VH_G and a high gray level of B gamma voltage VH_B applied to the R cell, the G cell and B cell, respectively are set in compliance with a white balance. At this time, when a high gray level, that is, a white is expressed, a high gray level of R, G and B gamma voltages VH_R, VH_G and VH_B can be flexibly controlled to effectively cope with various conditions of the panel with the aid of the first to third variable resistors VR1 to VR3.

When a third mode is selected, the first and second switches S1 and S2 are turned on. If the first and second switches S1 and S2 are turned on, then a parallel resistance value of the first variable resistor VR1 and the second and third voltage-dividing resistors R2 and R3 emerges between the first voltage-dividing resistor R1 and the ground voltage source GND in the R gamma voltage generator 42. That is to say, the resistance value is differentiated from the first and second modes. Thus, a low gray level of R gamma voltage VL_R and a high gray level of R gamma voltage VH_R when the third mode is selected are generated by a voltage division caused by a parallel resistance value of the first voltage-dividing R1 connected, in series, to the supply voltage source VDD and the first variable resistor VR1 and the second and third voltage-dividing resistors R2 and R3 connected, in parallel, between the first voltage-dividing resistor R1 and the ground voltage source GND. Further, if the first and second switches S2 are turned on, then a parallel resistance value of the second variable resistor VR2 and the 12th and 13th voltage-dividing resistors R12 and R13 emerges between the 11th voltage-dividing resistor R11 and the ground voltage source GND in the G gamma voltage generator 44. That is to say, the resistance value is differentiated from the first and second modes. Thus, a low gray level of G gamma voltage VL_G and a high gray level of G gamma voltage VH_G when the third mode is selected are generated by a voltage division caused by a parallel resistance value of the 11th voltage-dividing R11 connected, in series, to the supply voltage source VDD and the second variable resistor VR2 and the 12th and 13th voltage-dividing resistors R12 and R13 connected, in parallel, between the 11th voltage-dividing resistor R11 and the ground voltage source GND. Furthermore, if the first and second switches S1 and S2 are turned on, then a parallel resistance value of the third variable resistor VR3 and the 22nd and 23rd voltage-dividing resistors R22 and R23 emerges between the 21st voltage-dividing resistor R21 and the ground voltage source GND in the B gamma voltage generator 46. That is to say, the resistance value is differentiated from the first and second modes. Thus, a low gray level of B gamma voltage VL_B and a high gray level of B gamma voltage VH_B when the third mode is selected are generated by a voltage division caused by a parallel resistance value of the 21st voltage-dividing R21 connected, in series, to the supply voltage source VDD and the third variable resistor VR3 and the 22nd and 23rd voltage-dividing resistors R22 and R23 connected, in parallel, between the 21st voltage-dividing resistor R21 and the ground voltage source GND. Herein, since a high gray level of R, G and B gamma voltages VH_R, VH_G and VH_B generated by the R, G and B gamma voltage generators 42, 44 and 46 generate a brightness difference in correspondence with each light-emission efficiency of the R, G and B cells when a high gray level (i.e., white) is expressed, a high gray level of R gamma voltage VH_R, a high gray level of G gamma voltage VH_G and a high gray level of B gamma voltage VH_B applied to the R cell, the G cell and B cell, respectively are set in compliance with a white balance. At this time, when a high gray level, that is, a white is expressed, a high gray level of R, G and B gamma voltages VH_R, VH_G and VH_B can be flexibly controlled to effectively cope with various conditions of the panel with the aid of the first to third variable resistors VR1 to VR3.

On the other hand, a low gray level of R gamma voltage VL_R, a low gray level of G gamma voltage VL_G and a low gray level of B gamma voltage VL_B generated by the R, G and B gamma voltage generators 42, 44 and 46 are not largely influenced even though a voltage difference among a low gray level of R gamma voltage VL_R, a low gray level of G gamma voltage VL_G and a low gray level of B gamma voltage VL_B applied to the R cell, the G cell and the B cell, respectively exists for each of the first to third modes when a low gray level, that is, a black is expressed (wherein the black is expressed by a combination of gray levels of the R, G and B cells) because it is difficult to recognize the voltage difference by human eyes.

Figure 1:
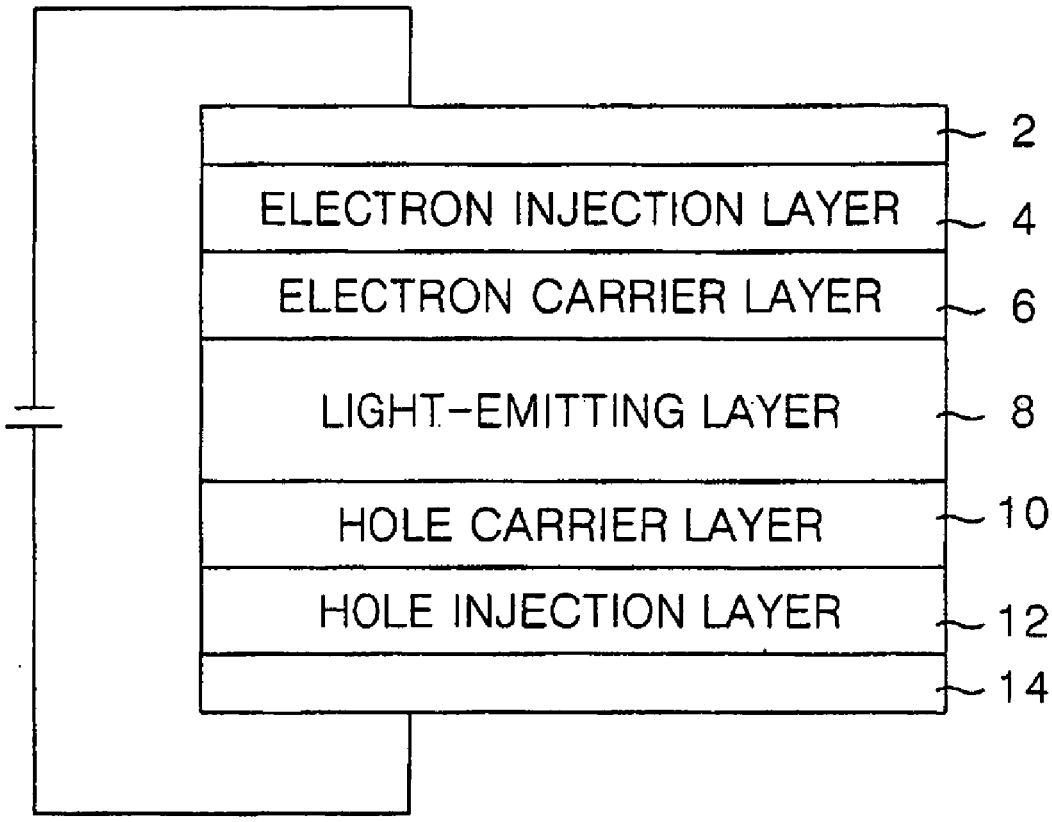
FIG. 1 RELATED ART
FIG. 1 is a schematic section view showing a structure of a general organic electro-luminescence display device.
Figure 2:
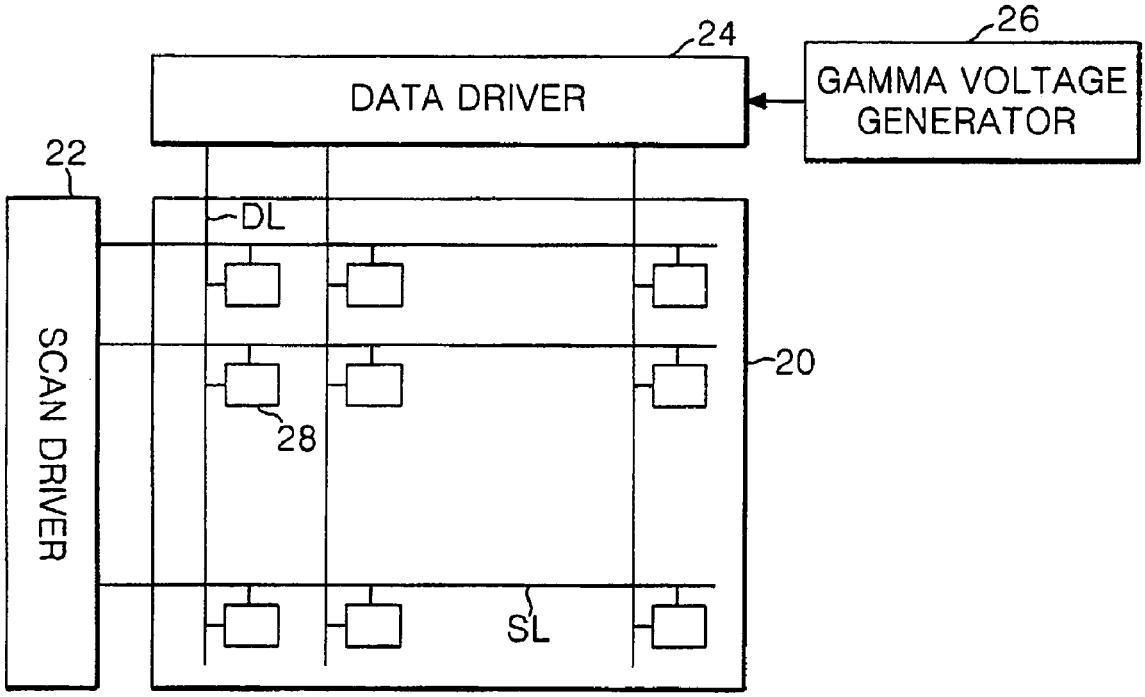
FIG. 2 RELATED ART
FIG. 2 is a schematic block diagram showing a configuration of a driving apparatus for a conventional electro-luminescence display panel.
Figure 3:
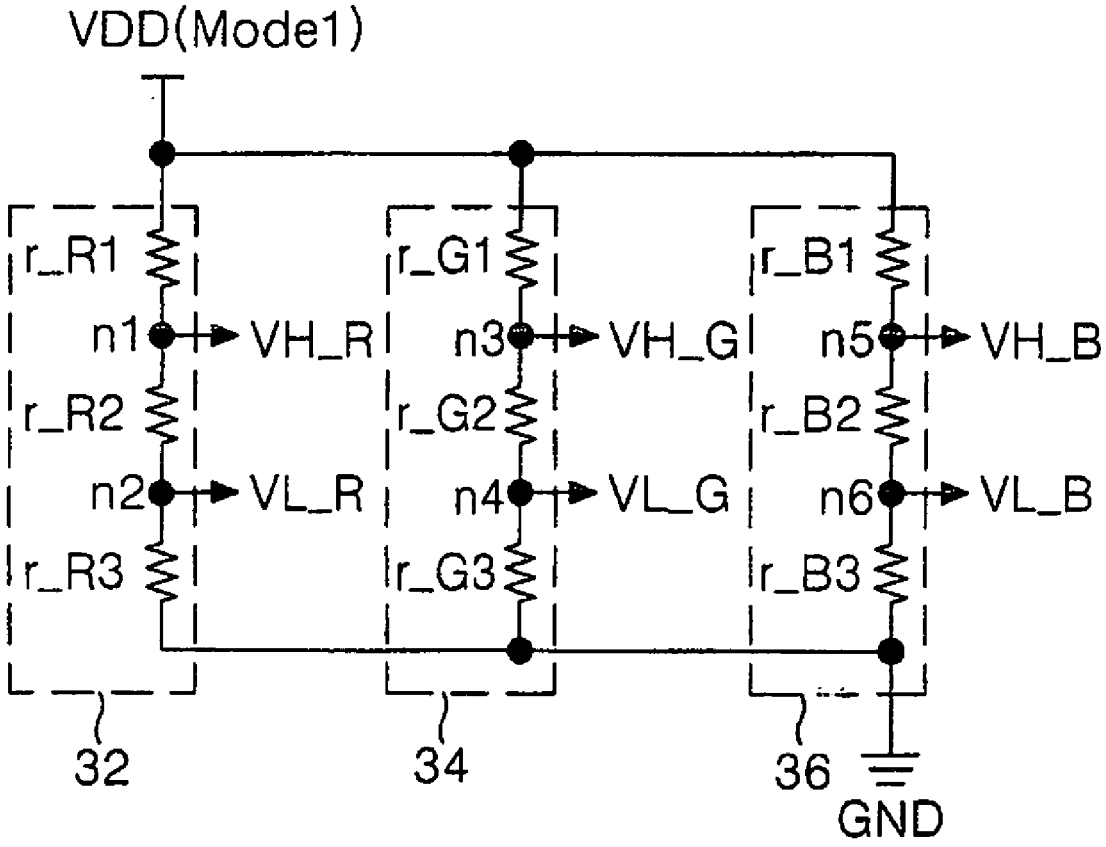
FIG. 3 RELATED ART
FIG. 3 is a detailed circuit diagram of the gamma voltage generator show in FIG. 2 when a first mode is selected.
Figure 4:
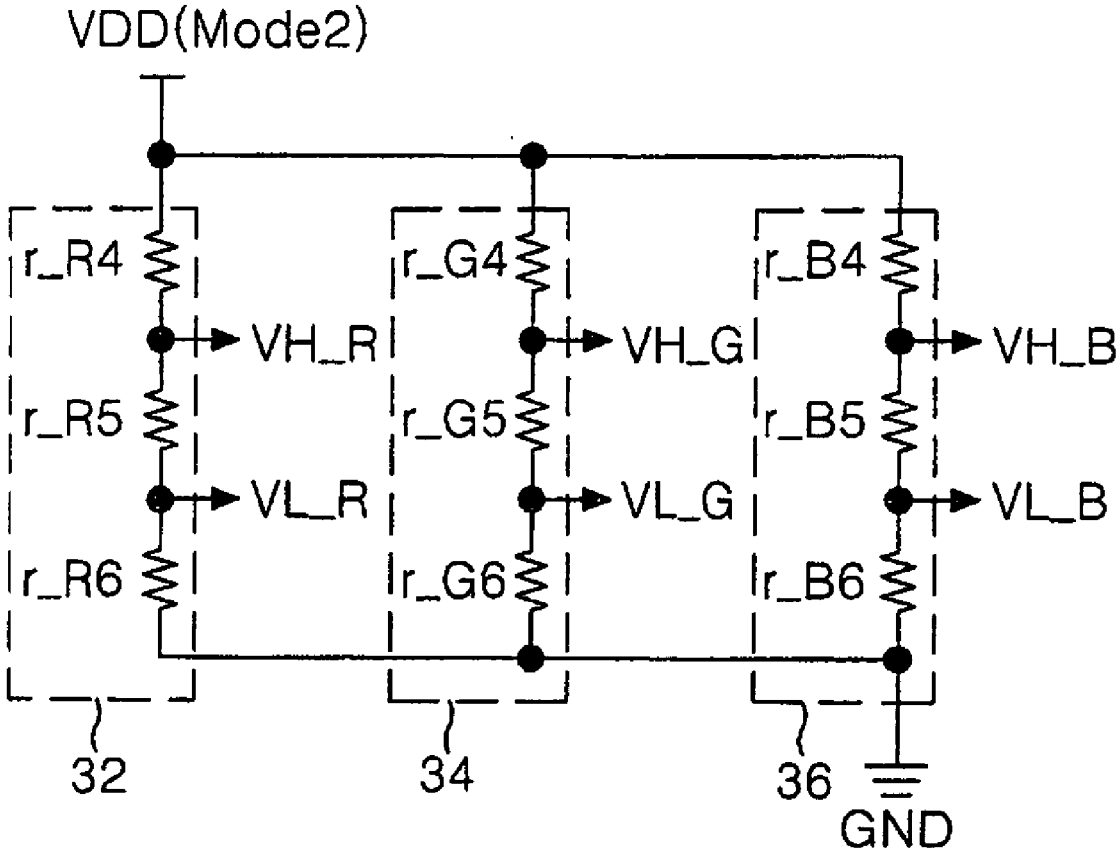
FIG. 4 RELATED ART
FIG. 4 is a detailed circuit diagram of the gamma voltage generator show in FIG. 2 when a second mode is selected.
Figure 5:
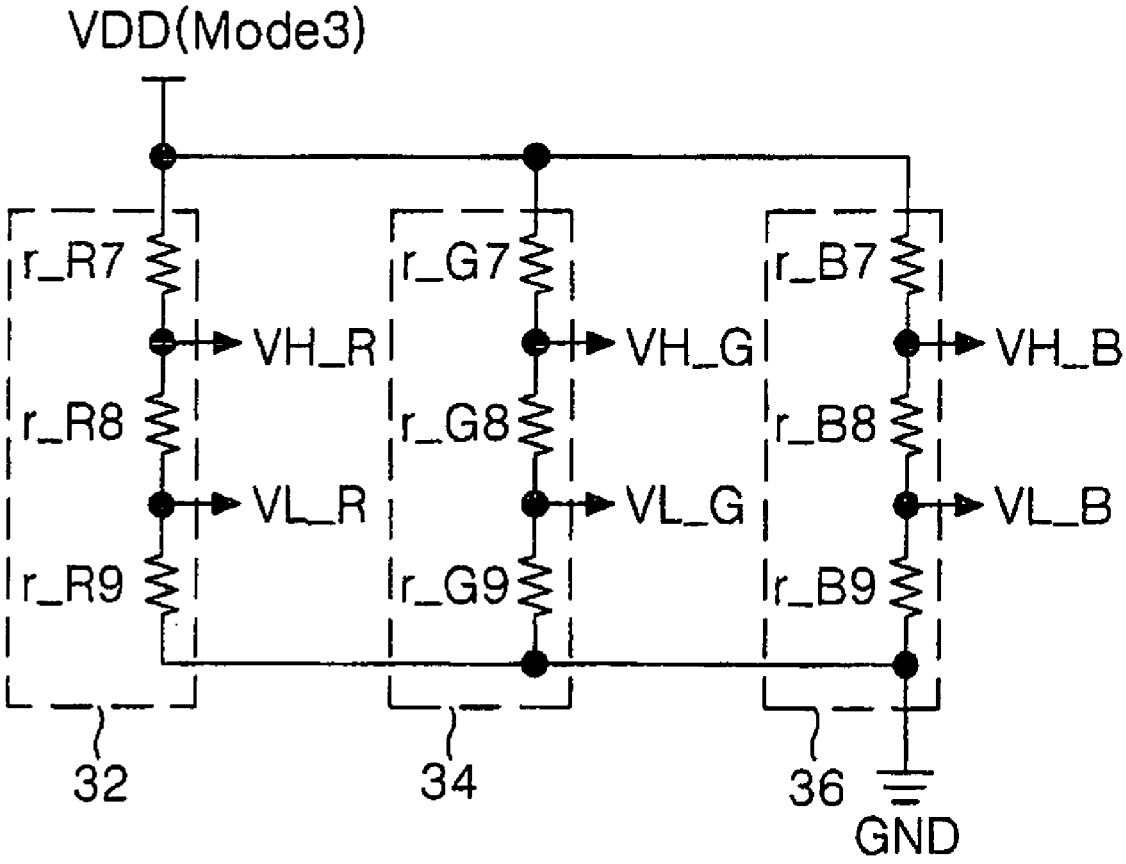
FIG. 5 RELATED ART
FIG. 5 is a detailed circuit diagram of the gamma voltage generator show in FIG. 2 when a third mode is selected.

Such a gamma voltage generating apparatus according to the first embodiment of the present invention allows each of the R, G and B gamma voltage generators 42, 44 and 46 to select the first to third mode, thereby generating a plurality of gamma voltages corresponding to the selected mode. The gamma voltages generated in this manner are applied to the data driver shown in FIG. 2. The data driver generates an analog data signal using a gamma voltage corresponding to an input digital data signal of the plurality of gamma voltages and then applies the generated analog data signal to the data line DL in such a manner to be synchronized with a scanning signal, thereby displaying a desired picture on the EL panel.

Figure 7:
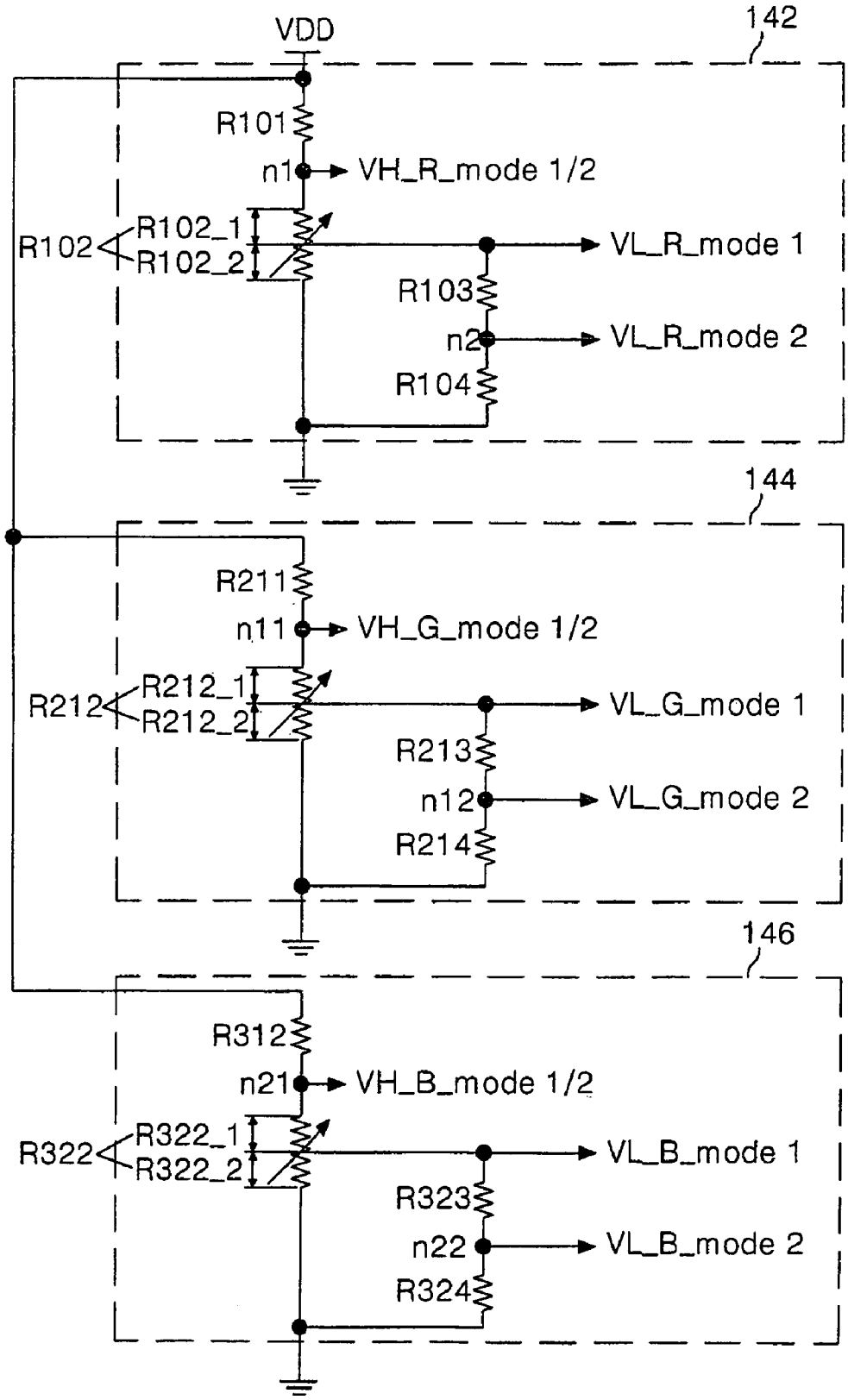
FIG. 7 is a circuit diagram of a gamma voltage generating apparatus according to a second embodiment of the present invention.

FIG. 7 is a circuit diagram of a gamma voltage generating apparatus according to a second embodiment of the present invention.

Referring to FIG. 7, the gamma voltage generating apparatus includes an R gamma voltage generator 142, a G gamma voltage generator 144 and a B gamma voltage generator 146 in order to supply a gamma voltage for each R, G and B cell. Herein, each of the R, G and B gamma voltage generators 142, 144 and 146 generates a gamma voltage in various modes in such a manner to correspond to an external environment.

The R gamma voltage generator 142 generates a low gray level of R gamma voltage VL_R and a high gray level of R gamma voltage VH_R and applies them to the R cell in order to express a low gray level (i.e., black) and a high gray level (i.e., white). To this end, the R gamma voltage generator 142 includes first and second voltage-dividing resistors R101 and R102 connected, in series, to a supply voltage source VDD, and third and fourth voltage-dividing resistors R103 and R104 connected, in series, between the second voltage-dividing resistor R102 and a ground voltage source GND. Herein, the second voltage-dividing resistor R102 employs a variable resistor, thereby allowing the gamma voltage generating apparatus to effectively cope with various conditions of the panel. Since a high gray level of R gamma voltage VH_R_Mode1/2 in the first and second modes express a black, a brightness difference is not largely generated even though the same gamma voltage is supplied. Thus, a high gray level of R gamma voltage VH_R_Mode1/2 in the first and second modes outputted from a common node n1 between the first voltage-dividing resistor R101 and the second voltage-dividing resistor R102 is applied to the R cell to thereby express a high gray level. In this case, a high gray level of R gamma voltage VH_R_Mode1/2 in the first and second modes applied to the R cell to express a high gray level is given by the following equation:

$$\text{VH_R_Mode1/2(a low gray level of gamma voltage)} = \frac{\dfrac{R2*(R3+R4)}{R2+(R3+R4)}}{R1+\dfrac{R2*(R3+R4)}{R2+(R3+R4)}}*VDD \quad (7)$$

Further, a low gray level of R gamma voltage VL_R_Mode1 in the first mode is outputted from any one point of the second voltage-dividing resistor R102, that is, the variable resistor in correspondence to a condition of the panel and is applied to the R cell, thereby expressing a low gray level. In this case, a low gray level of R gamma voltage VL_R_Mode1 in the first mode applied to the R cell to express a low gray level in the first mode is given by the following equation:

$$\text{VL_R_Mode1(a high gray level of gamma voltage)} = \frac{\dfrac{\text{R2_2}*(R3+R4)}{\text{R2_2}+(R3+R4)}}{R1+\dfrac{R2*(R3+R4)}{R2+(R3+R4)}}*VDD \quad (8)$$

Furthermore, a low gray level of R gamma voltage VL_R_Mode2 in the second mode is outputted from a common node n2 of the third and fourth voltage-dividing resistors R103 and R104 connected between a low gray level of R gamma voltage VL_R_Mode1 in the first mode and the ground voltage source GND in correspondence to a condition of the panel and is applied to the R cell, thereby expressing a low gray level. In this case, a low gray level of R gamma voltage VL_R_Mode2 in the second mode applied to the R cell to express a low gray level in the second mode is given by the following equation:

$$\text{VL_R_Mode2(a high gray level of gamma voltage)} = \frac{R4}{R3+R4}*\text{VL_R_Mode1} \quad (9)$$

The G gamma voltage generator 144 generates a low gray level of G gamma voltage VL_G and a high gray level of G gamma voltage VH_G and applies them to the G cell in order to express a low gray level (i.e., black) and a high gray level (i.e., white). To this end, the G gamma voltage generator 144 includes 11th and 12th voltage-dividing resistors R211 and R212 connected, in series, to the supply voltage source VDD, and 13th and 14th voltage-dividing resistors R213 and R214 connected, in series, between the 12th voltage-dividing resistor R212 and the ground voltage source GND. Herein, the 12th voltage-dividing resistor R212 employs a variable resistor, thereby allowing the gamma voltage generating apparatus to effectively cope with various conditions of the panel. Since a high gray level of G gamma voltage VH_G_Mode1/2 in the first and second modes express a black, a brightness difference is not largely generated even though the same gamma voltage is supplied. Thus, a high gray level of G gamma voltage VH_G_Mode1/2 in the first and second modes outputted from a common node n11 between the 11th voltage-dividing resistor R211 and the 12th voltage-dividing resistor R212 is applied to the G cell to thereby express a high gray level. In this case, a high gray level of G gamma voltage VH_G_Mode1/2 in the first and second modes applied to the G cell to express a high gray level is given by the following equation:

$$\text{VH_G_Mode1/2(a low gray level of gamma voltage)} = \frac{\dfrac{R12*(R13+R14)}{R12+(R13+R14)}}{R11+\dfrac{R12*(R13+R14)}{R12+(R13+R14)}}*VDD \quad (10)$$

Further, a low gray level of G gamma voltage VL_G_Mode1 in the first mode is outputted from any one point of the 12th voltage-dividing resistor R212, that is, the variable resistor in correspondence to a condition of the panel and is applied to the G cell, thereby expressing a low gray level. In this case, a low gray level of G gamma voltage VL_G_Mode1 in the first mode applied to the G cell to express a low gray level in the first mode is given by the following equation:

$$\text{VL_G_Mode1(a high gray level of gamma voltage)} = \frac{\dfrac{\text{R12_1}*(R13+R14)}{\text{R12_2}+(R13+R14)}}{R11+\dfrac{R12*(R13+R14)}{R12+(R13+R14)}}*VDD \quad (11)$$

Furthermore, a low gray level of G gamma voltage VL_G_Mode2 in the second mode is outputted from a common node n12 of the 13th and 14th voltage-dividing resistors R213 and R214 connected between a low gray level of G gamma voltage VL_G_Mode1 in the first mode and the ground voltage source GND in correspondence to a condition of the panel and is applied to the G cell, thereby expressing a low gray level. In this case, a low gray level of G gamma voltage VL_G_Mode2 in the second mode applied to the G cell to express a low gray level in the second mode is given by the following equation:

$$\text{VL_G_Mode2(a high gray level of gamma voltage)} = \frac{R14}{R13+R14}*\text{VL_G_Mode1} \quad (12)$$

The B gamma voltage generator 146 generates a low gray level of B gamma voltage VL_B and a high gray level of B gamma voltage VH_B and applies them to the B cell in order to express a low gray level (i.e., black) and a high gray level (i.e., white). To this end, the B gamma voltage generator 146 includes 21st and 22nd voltage-dividing resistors R321 and R322 connected, in series, to the supply voltage source VDD, and 23rd and 24th voltage-dividing resistors R323 and R324 connected, in series, between the 22nd voltage-dividing resistor R322 and the ground voltage source GND. Herein, the 22nd voltage-dividing resistor R322 employs a variable resistor, thereby allowing the gamma voltage generating apparatus to effectively cope with various conditions of the panel. Since a high gray level of B gamma voltage VH_B_Mode1/2 in the first and second modes express a black, a brightness difference is not largely generated even though the same gamma voltage is supplied. Thus, a high gray level of B gamma voltage VH_B_Mode1/2 in the first and second modes outputted from a common node n21 between the 21st voltage-dividing resistor R321 and the 22nd voltage-dividing resistor R322 is applied to the B cell to thereby express a high gray level. In this case, a high gray level of B gamma voltage VH_B_Mode1/2 in the first and second modes applied to the B cell to express a high gray level is given by the following equation:

$$\text{VH_B_Mode1/2(a low gray level of gamma voltage)} = \frac{\dfrac{R22*(R23+R24)}{R22+(R23+R24)}}{R21+\dfrac{R22*(R23+R24)}{R22+(R23+R24)}}*VDD \tag{13}$$

Further, a low gray level of B gamma voltage VL_B_Mode1 in the first mode is outputted from any one point of the 22nd voltage-dividing resistor R322, that is, the variable resistor in correspondence to a condition of the panel and is applied to the B cell, thereby expressing a low gray level. In this case, a low gray level of B gamma voltage VL_B_Mode1 in the first mode applied to the B cell to express a low gray level in the first mode is given by the following equation:

$$\text{VL_B_Mode1(a high gray level of gamma voltage)} = \frac{\dfrac{\text{R22_1}*(R23+R24)}{\text{R22_2}+(R23+R24)}}{R21+\dfrac{R22*(R23+R24)}{R22+(R23+R24)}}*VDD \tag{14}$$

Furthermore, a low gray level of B gamma voltage VL_B_Mode2 in the second mode is outputted from a common node n22 of the 23rd and 24th voltage-dividing resistors R323 and R324 connected between a low gray level of B gamma voltage VL_B_Mode1 in the first mode and the ground voltage source GND in correspondence to a condition of the panel and is applied to the B cell, thereby expressing a low gray level. In this case, a low gray level of B gamma voltage VL_B_Mode2 in the second mode applied to the B cell to express a low gray level in the second mode is given by the following equation:

$$\text{VL_B_Mode2(a high gray level of gamma voltage)} = \frac{R24}{R23+R24}*\text{VL_B_Mode1}, \tag{15}$$

Meanwhile, since a low gray level of R, G and B gamma voltages VL_R_Mode1, VL_G_Mode1 and VL_B_Mode1 generated by the R, G and B gamma voltage generators 142, 144 and 146 when the first mode is selected generate a brightness difference in correspondence with each light-emission efficiency of the R, G and B cells when a low gray level (i.e., white) is expressed (wherein the white is expressed by a combination of gray levels of the R, G and B cells), a low gray level of R gamma voltage VL_R_Mode1, a low gray level of G gamma voltage VL_G_Mode1 and a low gray level of B gamma voltage VL_B_Mode1 applied to the R cell, the G cell and B cell, respectively are set in compliance with a white balance.

Since a low gray level of R, G and B gamma voltages VL_R_Mode2, VL_G_Mode2 and VL_B_Mode2 generated by the R, G and B gamma voltage generators 142, 144 and 146 when the second mode is selected generate a brightness difference in correspondence with each light-emission efficiency of the R, G and B cells when a low gray level (i.e., white) is expressed (wherein the white is expressed by a combination of gray levels of the R, G and B cells), a low gray level of R gamma voltage VL_R_Mode2, a low gray level of G gamma voltage VL_G_Mode2 and a low gray level of B gamma voltage VL_B_Mode2 applied to the R cell, the G cell and B cell, respectively are set in compliance with a white balance.

On the other hand, a high gray level of R gamma voltage VH_R_Mode1/2 in the first and second modes, a high gray level of G gamma voltage VH_G_Mode1/2 in the first and second modes and a high gray level of B gamma voltage VH_B_Mode1/2 in the first and second modes generated by the R, G and B gamma voltage generators 142, 144 and 146 are not largely influenced even though they have a voltage difference when a high gray level, that is, a black is expressed (wherein the black is expressed by a combination of gray levels of the R, G and B cells) because it is difficult to recognize the voltage difference by human eyes.

Such a gamma voltage generating apparatus according to the second embodiment of the present invention allows each of the R, G and B gamma voltage generators 142, 144 and 146 to select the first and second mode, thereby generating a plurality of gamma voltages corresponding to the selected mode. In this case, when a high gray level is expressed, the variable resistor can be used to cope with various conditions of the panel. The gamma voltages generated in this manner are applied to the data driver shown in FIG. 2. The data driver generates an analog data signal using a gamma voltage corresponding to an input digital data signal of the plurality of gamma voltages and then applies the generated analog data signal to the data line DL in such a manner to be synchronized with a scanning signal, thereby displaying a desired picture on the EL panel.

As described above, the gamma voltage generating apparatus according to the present invention can reduce the number of parts in each of the red, green and blue gamma voltage generators to make a gray level expression, so that it becomes possible to reduce the EL module and hence simplify a structure thereof. Furthermore, the gamma voltage generating apparatus according to the present invention can use the variable resistor to effectively cope with various conditions of the panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A gamma voltage generating apparatus operated in various modes such that a brightness value is changeable in correspondence with an external environment, said apparatus comprising:

a red gamma voltage generator, having at least one variable resistor and a plurality of parallel resistors connected, in parallel, between the variable resistor and a ground voltage source, for generating a plurality of red gamma voltages and controlling the plurality of red gamma voltages such that said brightness value is changeable in correspondence with each of said various modes;

a green gamma voltage generator, at least one variable resistor and a plurality of parallel resistors connected, in parallel, between the variable resistor and a ground voltage source, for generating a plurality of green gamma voltages and controlling the plurality of green gamma voltages such that said brightness value is changeable in correspondence with each of said various modes; and a blue gamma voltage generator, having at least one variable resistor and a plurality of parallel resistors connected, in parallel, between the variable resistor and a ground voltage source, for generating a plurality of blue gamma voltages and controlling the plurality of blue gamma voltages such that said brightness value is changeable in correspondence with each of said various modes.

2. The gamma voltage generating apparatus according to claim 1, wherein each of the red, green and blue gamma voltage generators includes:

a supply voltage source; and a first resistor and the at least one variable resistor connected to the supply voltage source.

3. The gamma voltage generating apparatus according to claim 2, wherein a gamma voltage corresponding to a first gray level is generated from a first common node between the first resistor and the at least one variable resistor, and a gamma voltage corresponding to a second gray level is generated from a common node of the variable resistor connected, in parallel, between the first common node and the ground voltage source and said parallel resistors.

4. The gamma voltage generating apparatus according to claim 3, wherein a plurality of switches is provided between said parallel resistors and the ground voltage source.

5. The gamma voltage generating apparatus according to claim 4, wherein the switches are turned on and off in correspondence with each of said modes, and values of said gamma voltages corresponding to the first and second gray levels are changed when the switches are turned on and off.

6. The gamma voltage generating apparatus according to claim 2, wherein resistance values of the first resistor, the at least one variable resistor and said parallel resistors are set differently at each of the red, green and blue gamma voltage generators.

7. The gamma voltage generating apparatus according to claim 6, wherein resistance values of said resistors included in each of the red, green and blue gamma voltage generators are set in compliance with a white balance of red, green and blue cells.

8. A gamma voltage generating apparatus operated in various modes such that a brightness value can be changed in correspondence with an external environment, said apparatus comprising:

a red gamma voltage generator, having at least one variable resistor device for generating a plurality of red gamma voltages and controlling the plurality of red gamma voltages such that said brightness value can be changed in correspondence with each of said various modes, for generating the plurality of red gamma voltages corresponding to each of said modes by at least two resistor devices connected, in series, between the variable resistor device and a ground voltage source;

a green gamma voltage generator, having at least one variable resistor device for generating a plurality of green gamma voltages and controlling the plurality of green gamma voltages such that said brightness value can be changed in correspondence with each of said various modes, for generating the plurality of green gamma voltages corresponding to each of said modes by at least two resistor devices connected, in series, between the variable resistor device and the ground voltage source; and a blue gamma voltage generator, having at least one variable resistor device for generating a plurality of blue gamma voltages and controlling the plurality of blue gamma voltages such that said brightness value can be changed in correspondence with each of said various modes, for generating the plurality of blue gamma voltages corresponding to each of said modes by at least two resistor devices connected, in series, between the variable resistor device and the ground voltage source.

9. The gamma voltage generating apparatus according to claim 8, wherein each of the red, green and blue gamma voltage generators includes:

a supply voltage source;

a first resistor device and a variable resistor device connected to the supply voltage source; and i serial resistor devices (wherein i is an integer) connected, in series, between the variable resistor device and the ground voltage source.

10. The gamma voltage generating apparatus according to claim 9, wherein a gamma voltage corresponding to a first gray level is generated from a first common node between the first resistor device and the variable resistor device, and a gamma voltage corresponding to a second gray level is generated from each node between said i serial resistor devices connected, in series, the variable resistor device and the ground voltage source.

11. The gamma voltage generating apparatus according to claim 10, wherein said second gray level is generated from each node between said i serial resistor devices in correspondence with each of said modes.

12. The gamma voltage generating apparatus according to claim 9, wherein resistance values of the first resistor device, the variable resistor device and said i serial resistor devices are set differently at each of the red, green and blue gamma voltage generators.

13. The gamma voltage generating apparatus according to claim 12, wherein resistance values of said resistor devices included in each of the red, green and blue gamma voltage generators are set in compliance with a white balance of red, green and blue cells.

14. A gamma voltage generating apparatus operated in various modes such that a brightness value is changeable, said apparatus comprising:

at least one gamma voltage generator, the at least one gamma voltage generator having at least one variable resistor and a plurality of parallel resistors connected, in parallel, between the variable resistor and a ground voltage source, for generating a plurality of gamma voltages and controlling the plurality of gamma voltages such that said brightness value is changeable in correspondence with said various modes.

15. The gamma voltage generating apparatus according to claim 14, wherein the at least one gamma voltage generator is for changing said brightness value of a first color.

16. The gamma voltage generating apparatus according to claim 14, wherein the at least one gamma voltage generator includes a plurality of gamma voltage generators corresponding to a plurality of colors.

17. The gamma voltage generating apparatus according to claim 14, wherein the at least one gamma voltage generator further includes:

a supply voltage source; and a first resistor, the first resistor and the at least one variable resistor being connected in series to the supply voltage source.

18. A gamma voltage generating apparatus operated in various modes such that a brightness value is changeable, said apparatus comprising:

at least one gamma voltage generator, the at least one gamma voltage generator having at least one variable resistor and a plurality of series resistors connected, in series, between the at least one variable resistor and a ground voltage source, for generating a plurality of gamma voltages and controlling the plurality of the gamma voltages such that said brightness value is changeable in correspondence with said various modes.

19. The gamma voltage generating apparatus according to claim 18, wherein the at least one gamma voltage generator is for changing said brightness value of a first color.

20. The gamma voltage generating apparatus according to claim 18, wherein the at least one gamma voltage generator includes a plurality of gamma voltage generators corresponding to a plurality of colors.

21. The gamma voltage generating apparatus according to claim 18, wherein the at least one gamma voltage generator further includes:

a supply voltage source; and a first resistor, the first resistor and the at least one variable resistor being connected in series to the supply voltage source.

* * * * *